US009270014B2

(12) United States Patent
Lin

(10) Patent No.: US 9,270,014 B2
(45) Date of Patent: Feb. 23, 2016

(54) HANDHELD ELECTRONIC DEVICE

(71) Applicant: Acer Incorporated, New Taipei (TW)

(72) Inventor: Ching-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 318 days.

(21) Appl. No.: 13/709,078

(22) Filed: Dec. 10, 2012

(65) Prior Publication Data

US 2014/0062798 A1 Mar. 6, 2014

(30) Foreign Application Priority Data

Aug. 28, 2012 (TW) ..... 101131225 A

(51) Int. Cl.

| | |
|---|---|
| ***H01Q 1/24*** | (2006.01) |
| ***H01Q 1/48*** | (2006.01) |
| ***H01Q 1/22*** | (2006.01) |
| ***H01Q 1/44*** | (2006.01) |
| ***H01Q 9/42*** | (2006.01) |

(52) U.S. Cl.

CPC ..... *H01Q 1/243* (2013.01); *H01Q 1/2266* (2013.01); *H01Q 1/44* (2013.01); *H01Q 9/42* (2013.01)

(58) Field of Classification Search

CPC ..... H01Q 1/243; H01Q 1/2266; H01Q 1/44; H01Q 9/42

See application file for complete search history.

(56) References Cited

U.S. PATENT DOCUMENTS

| | | | | |
|---|---|---|---|---|
| 2005/0285794 | A1 | 12/2005 | Tang et al. | |
| 2007/0176831 | A1 * | 8/2007 | Lagnado et al. | 343/702 |
| 2010/0073242 | A1 * | 3/2010 | Ayala Vazquez et al. | 343/702 |
| 2010/0073243 | A1 * | 3/2010 | Ayala Vazquez et al. | 343/702 |
| 2012/0068893 | A1 * | 3/2012 | Guterman et al. | 343/702 |
| 2012/0162046 | A1 * | 6/2012 | Hung et al. | 343/892 |

FOREIGN PATENT DOCUMENTS

| | | | | |
|---|---|---|---|---|
| CN | 1525596 | | 9/2004 | |
| CN | 2891096 | | 4/2007 | |
| CN | 101093099 | | 12/2007 | |
| CN | 101106211 | | 1/2008 | |
| CN | 201732860 | | 2/2011 | |
| CN | 102544699 | | 7/2012 | |
| CN | 102569988 | | 7/2012 | |
| EP | 1686654 | | 12/2008 | |
| EP | 1825345 | | 2/2011 | |
| JP | 11-135970 | * | 5/1999 | H05K 7/20 |
| TW | 465140 | | 11/2001 | |
| TW | M359815 | | 6/2009 | |
| TW | 201119141 | | 6/2011 | |
| TW | M423366 | | 2/2012 | |
| TW | 201228109 | | 7/2012 | |

* cited by examiner

*Primary Examiner* — Trinh Dinh
(74) *Attorney, Agent, or Firm* — Jianq Chyun IP Office

(57) ABSTRACT

A handheld electronic device is provided. The handheld electronic device includes a main body, a heat vent structure, and an antenna. The heat vent structure is disposed on the main body. The antenna is disposed on the heat vent structure for transmitting/receiving at least one radio frequency signal.

3 Claims, 2 Drawing Sheets

HANDHELD ELECTRONIC DEVICE

CROSS-REFERENCE TO RELATED APPLICATION

This application claims the priority benefit of Taiwan application serial no. 101131225, filed on Aug. 28, 2012. The entirety of the above-mentioned patent application is hereby incorporated by reference herein and made a part of this specification.

BACKGROUND OF THE INVENTION

1. Field of the Invention

The invention relates to a handheld electronic device. More particularly, the invention relates to a handheld electronic device having an antenna disposed on the heat vent structure.

2. Description of Related Art

Along with the continuous development of the technology, current trend of designing handheld electronic devices (e.g., a notebook PC or a tablet PC) is aimed to make the device lighter and thinner. Metal is one of the most widely used materials for a chassis of the handheld electronic devices, which makes the devices much more delicate while maintaining a lighter and thinner appearance. However, the designer may face a tougher challenge when using a metallic chassis. The first and immediate challenge is how to dispose key parts on the device, such as an antenna.

Radiation characteristic of the antenna directly affects the quality of overall signal recipient. A favorable antenna usually requires a fair environment in order to function properly, but a radiation space for the antenna in the handheld devices nowadays has been compressed due to the design concept of making the devices lighter and thinner. Moreover, when the metallic chassis is used by the handheld electronic device, radiation effects of the antenna may also be shielded thereby. In order to solve such problem, an antenna window must be opened on the metallic chassis so that the antenna may successfully transmitting/receiving signal without having the radiation effects being shielded. In consideration of appearance integrity of the handheld electronic device, position and shape of the antenna window must also be carefully considered. The most preferable consideration for designing the metallic chassis is by adding no additional holes thereon, so as to maintain the appearance integrity of the device. Accordingly, a question of how to maintain the appearance integrity of the handheld electronic device while considering the radiation characteristic of the antenna has become one of the major problems to be solved in the field.

SUMMARY OF THE INVENTION

The invention is directed to a handheld electronic device, in which an antenna is disposed by using the heat vent structure of the handheld device.

A handheld electronic device is provided. The handheld electronic device includes a main body, a heat vent structure, and an antenna. The heat vent structure is disposed on the main body. The antenna is disposed on the heat vent structure and configured for transmitting/receiving at least one of radio frequency signals.

According to an embodiment of the invention, the main body includes a first main body and a second main body, in which the second main body is connected to the first main body through a pivotal shaft, and adapted for opening/closing relatively with the first main body.

According to an embodiment of the invention, the main body and the heat vent structure are made of metal materials. Further, the antenna is formed by using a fence structure of the heat vent structure in the handheld electronic device.

According to an embodiment of the invention, the radio frequency signals include a first radio frequency signal and a second radio frequency signal. Also, the fence structure includes a T-shaped radiating portion and at least one parasitic portion. The T-shaped radiating portion includes a connecting portion, a first radiating portion and a second radiating portion. The first radiating portion and the second radiating portion are vertical to the connecting portion, and the first radiating portion and the second radiating portion are extended away from each other. In which, a first mode is generated by the connecting portion and the first radiating portion for transmitting/receiving a first radio frequency signal. And a second mode is generated by the connecting portion and the second radiating portion for transmitting/receiving a second radio frequency signal. At least one parasitic portion is adjacent to the T-shaped radiating portion and configured to adjust an impedance matching value of first mode and/or an impedance matching value of second mode.

According to an embodiment of the invention, in which the main body and the heat vent structure are made of non-metal materials, and the antenna is fixed on an inner side of a fence structure of the heat vent structure.

According to an embodiment of the invention, the radio frequency signals include a first radio frequency signal and a second radio frequency signal, and the antenna includes a T-shaped radiating portion and at least one parasitic portion. The T-shaped radiating portion includes a connecting portion, a first radiating portion and a second radiating portion. The first radiating portion and the second radiating portion are vertical to the connecting portion, and the first radiating portion and the second radiating portion are extended away from each other. In which, a first mode is generated by the connecting portion and the first radiating portion for transmitting/receiving a first radio frequency signal, and a second mode is generated by the connecting portion and the second radiating portion for transmitting/receiving a second radio frequency signal. A grounding portion is connected to a system ground plane. At least one parasitic portion is adjacent to the T-shaped radiating portion and configured to adjust an impedance matching value of first mode and/or an impedance matching value of second mode.

Based on above, the invention provides a handheld electronic device which forms an antenna by using the heat vent structure in the handheld electronic device for transmitting/receiving signals. As a result, the handheld electronic device may not require any additional antenna window or holes being disposed on the chassis in considering of the radiation characteristic of the antenna, thereby maintaining the appearance integrity of the handheld electronic device.

To make the above features and advantages of the invention more comprehensible, several embodiments accompanied with drawings are described in detail as follows.

DESCRIPTION OF THE EMBODIMENTS

The invention provides an antenna formed by using a heat vent structure in order to follow design trend of making handheld electronic devices lighter and thinner while maintaining the effectiveness of the antenna thereof. Since the heat vent is an indispensable structure in designing the handheld electronic device, above-said disposition may not affect the appearance integrity of the handheld electronic device.

Figure 1:
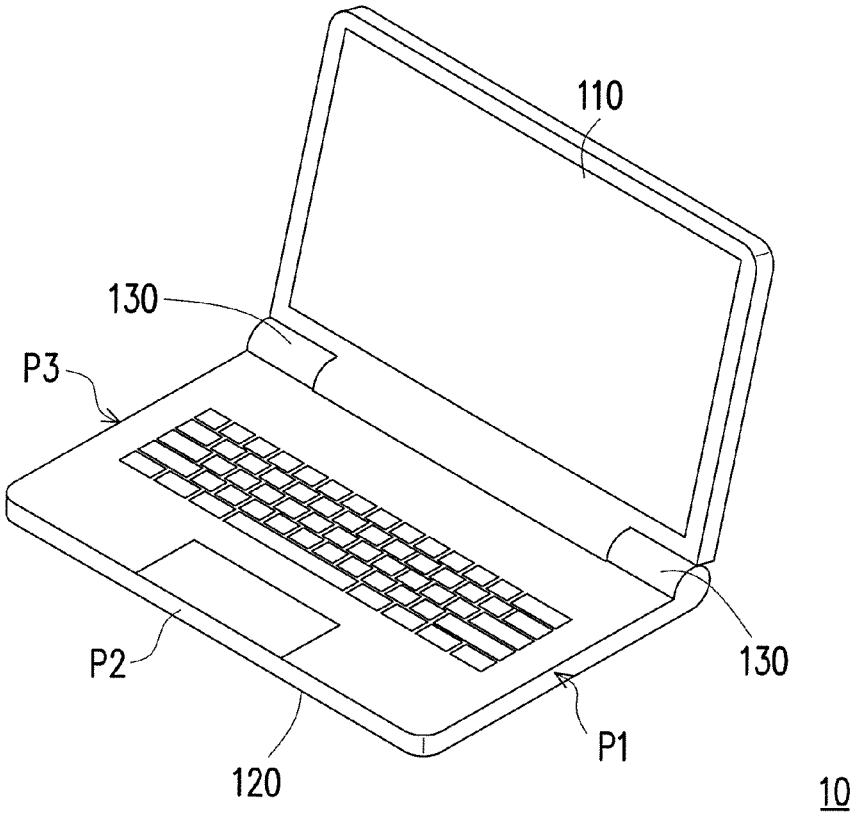
FIG. 1 is a schematic diagram illustrating an external view of a handheld electronic device according to an embodiment of the invention.

FIG. 1 is a schematic diagram illustrating an external view of a handheld electronic device according to an embodiment of the invention. In the present embodiment, the handheld electronic device is a notebook PC, but the invention is not limited thereto. Any handheld electronic device having the antenna disposed on the heat vent structure falls in the scope of the invention. Referring to FIG. 1, a handheld electronic device 10 includes a first main body 110 and a second main body 120. In which, the second main body 120 is connected to the first main body 110 though a pivotal shaft 130 and adapted for opening/closing relatively with the first main body 110. Take a notebook PC as an example, the first main body 110 may include A and B covers, and the second main body 120 may include C and D covers. Generally, owing to the design concept and inner structure being used, a heat vent structure is usually disposed on a lateral side of the second main body 120, for instance, positions P1-P3. The antenna of the invention is disposed by using the heat vent structure disposed at one of said positions. It should be noted that, the handheld electronic device of the invention may also be a tablet PC, a smart phone and a notebook PC. The notebook PC is merely used herein as an example, the invention is not limited to the above-said devices.

Implementations for metal materials and non-metal materials are respectively provided in accordance with different materials being used for a chassis of the second main body 120 of the handheld electronic device 10. According to the material selected for the chassis, the materials for the heat vent structure may also be divided into metal materials and non-metal materials. Different implementations are used for forming the antenna since the heat vent structure may be made of two different types of materials. The implementations for said two different types of materials will be described in details in the following with reference to accompany the drawings.

Figure 2:
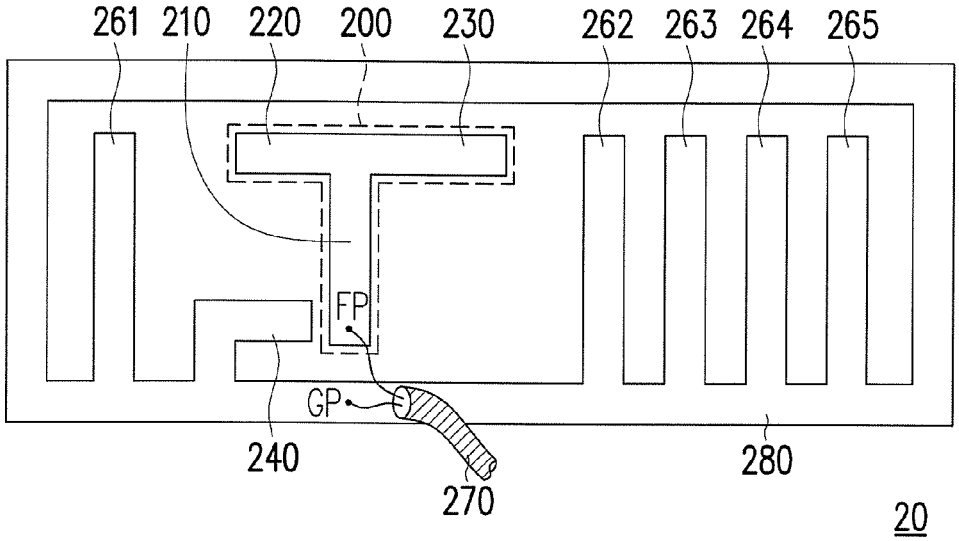
FIG. 2 is a schematic diagram illustrating a heat vent structure according to an embodiment of the invention.

FIG. 2 is a schematic diagram illustrating a heat vent structure according to an embodiment of the invention, in which the main body of the handheld electronic device and the heat vent structure disposed on the main body are both made of metal materials. Therefore, the antenna may be formed by directly altering a portion of a fence structure of the heat vent structure in the handheld electronic device (e.g., the handheld electronic device 10 as illustrated in FIG. 1) of the present embodiment.

FIG. 2 is a schematic diagram illustrating a heat vent structure according to an embodiment of the invention, in which an antenna is formed by using the fence structure of the handheld electronic device in the present embodiment. Referring to FIG. 2, a heat vent structure 20 includes a T-shaped radiating portion 200, a parasitic portion 240, a plurality of fences 261 to 265 and an outer frame 280. The T-shaped radiating portion 200 includes a connecting portion 210, a first radiating portion 220 and a second radiating portion 230. The first radiating portion 220 and the second radiating portion 230 are vertical to the connecting portion 210, and the first radiating portion 220 and the second radiating portion 230 are extended away from each other. A first mode is generated by the connecting portion 210 and the first radiating portion 220 for transmitting/receiving a first radio frequency signal. A second mode is generated by the connecting portion 210 and the second radiating portion 230 for transmitting/receiving a second radio frequency signal. Herein, the connecting portion 210 is not electronically connected to the outer frame 280 directly, which means that a non-conductive material may be used to support the T-shaped radiating portion 200 between the outer frame 280 and the connecting portion 210.

In the present embodiment, the heat vent structure 20 is connected to a coaxial cable 270. The coaxial cable 270 has an inner conductor and an outer conductor, in which the inner conductor is connected to a feeding point FP on the T-shaped radiating portion 200, and the outer conductor is connected to a grounding point GP on the outer frame 280. The first radio frequency signal or the second radio frequency signal transmitted/received by the antenna formed by the heat vent structure 20 may be transmitted through the coaxial cable 270.

It should be noted that lengths of the first radiating portion 220 and the radiating portion 230 are different. According to the present embodiment, a length of the first radiating portion 220 is shorter then a length of the second radiating portion 230. An overall length of the connecting portion 210 and the first radiating portion 220 is one fourth to a wave length of the first radio frequency signal. An overall length of the connecting portion 210 and the second radiating portion 230 is one fourth to a wave length of the second radio frequency signal. For instance, the first radio frequency signal and the second radio frequency signal are radio frequency signals compatible with Wireless Fidelity (WiFi) standard having a center frequency of 5 G Hz and 2.4 G Hz, respectively.

The parasitic portion 240 is adjacent to the T-shaped radiating portion 200 and configured to adjust an impedance matching value for transmitting/receiving the first radio frequency signal and an impedance matching value for transmitting/receiving the second radio frequency signal. Since the outer frame 280 is directly connected to the chassis and the system ground plane of the handheld electronic device (e.g., the handheld electronic device 10 as illustrated in FIG. 1), the fences 261 to 265 may practically be considered as parasitic elements extended from the ground plane. Variations to the distances between the fences 261 to 265 and the T-shaped radiating portion 200 may provide various effects on the impedance matching values for transmitting/receiving the first or the second radio frequency signal.

Therefore, the fences 261 to 265 and the outer frame 280 must first be disposed before disposing of the antenna 20. Next, a thickness and a length of T-shaped radiating portion 200 are adjusted according to frequency levels of the first radio frequency signal and the second radio frequency signal. Next, the impedance matching value for transmitting/receiving the first radio frequency signal and/or the impedance matching value for transmitting/receiving the second radio frequency signal are adjusted by the parasitic portion (e.g., the parasitic portion 240). As a result, the affection from the fences 261 to 265 and the outer frame to the impedance matching value for transmitting/receiving the first radio frequency signal and the impedance matching value for transmitting/receiving the second radio frequency signal, is now being considered.

Figure 3:
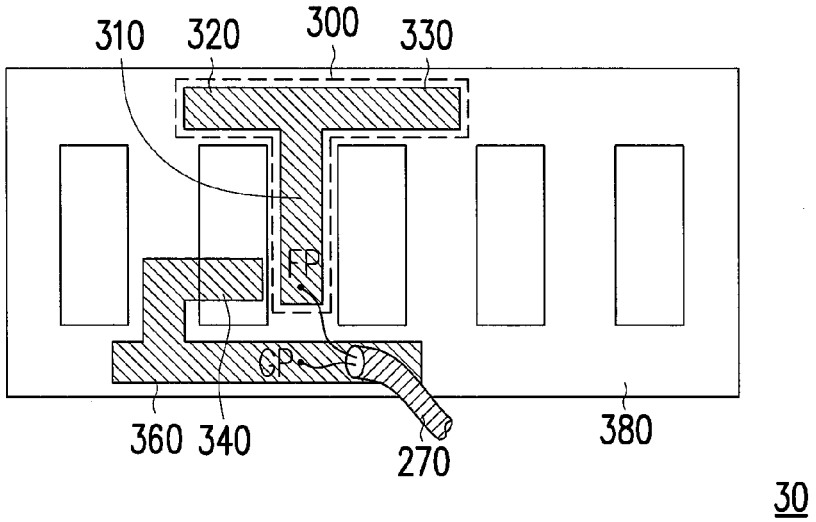
FIG. 3 is a schematic diagram illustrating a heat vent structure according to an embodiment of the invention.

FIG. 3 is a schematic diagram illustrating a heat vent structure according to an embodiment of the invention. In the present embodiment, the heat vent structure is made of no-metal materials. Referring to FIG. 3, a handheld electronic device (e.g., the handheld electronic device 10 as illustrated in FIG. 1) is disposed with an antenna at a space between the heat vent structure 30 and coiling fins (not illustrated) within the handheld electronic device. Referring to FIG. 3, the heat vent structure 30 includes a fence outer frame 380, a T-shaped radiating portion 300, a parasitic portion 340 and a grounding portion 360.

It should be noted that, the T-shaped radiating portion 300 is made of conductive material which includes a connecting portion 310, a first radiating portion 320 and a second radiating portion 330. The first radiating portion 320 and the second radiating portion 330 are vertical to the connecting portion 310, and the first radiating portion 320 and the second radiating portion 330 are extended away from each other. In which, a first mode is generated by the connecting portion 310 and the first radiating portion 320 for transmitting/receiving a first radio frequency signal, and a second mode is generated by the connecting portion 310 and the second radiating portion 330 for transmitting/receiving a second radio frequency signal.

The grounding portion 360 is connected to a chassis and a system ground plane of the handheld electronic device (not illustrated). The parasitic portion 340 is extended from the grounding portion 360 to be adjacent to the T-shaped radiating portion 300, configured to adjust an impedance matching value for transmitting/receiving the first radio frequency signal and/or an impedance matching value for transmitting/receiving the second radio frequency signal.

In the present embodiment, the heat vent structure 30 is connected to a coaxial cable 270. The coaxial cable 270 has an inner conductor and an outer conductor, in which the inner conductor is connected to a feeding point FP on the T-shaped radiating portion 300, and the outer conductor is connected to a grounding point GP on the grounding portion 360. A first radio frequency signal or a second radio frequency signal transmitted/received by the antenna formed by the heat vent structure 30 may be transmitted through the coaxial cable 270.

The difference between the embodiment in FIG. 3 and the embodiment in FIG. 2 lies where the T-shaped radiating portion 330 of conductive material, the parasitic portion 340 and the grounding portion are fixed on the fence outer frame 380 of non-conductive material in the embodiment of FIG. 3. In addition, referring to embodiments of both FIG. 2 and FIG. 3, a non-conductive net structure is further disposed on the fence outer frame 380 or the heat vent structure 20 so that holes on the heat vent structure 20 or 30 may be covered. As a result, the handheld electronic device may have an attractive appearance and no foreign particles can fall into the handheld electronic device easily.

It should be noted that, the disclosures of FIG. 2 and FIG. 3 are merely two of the implementations of the invention. The invention is aimed to use the heat vent as the radiation space for the antenna. The shape of the fence structure of the heat vent structure and the type of the antenna used are not particularly limited in the invention. For example, the heat vent structure is not limited to rectangle, which may be altered according to the shape of the handheld electronic device. The type of antenna may be a monopole antenna, a dipole antenna, a planar inverted F antenna (PIFA) or other specific types of antennas, the invention is not limited thereto.

Base on above, the invention provides a handheld electronic device, in which an antenna is disposed on the heat vent structure and configured for transmitting/receiving at least one radio frequency signal. The antenna may have different implementations according to the material used for the chassis of the handheld electronic device. For example, when the chassis of the handheld electronic device is made of metal materials, the antenna may be from by directly using the fence structure of the heat vent structure. When the chassis of the handheld electronic device is made of non-metal materials, the antenna may be fixed on the fence structure of the heat vent structure. Accordingly, the appearance integrity of the handheld electronic device may be maintained since no additional holes are required on the chassis of the handheld electronic device for providing the radiation space to the antenna. Furthermore, the radiating efficiency of the antenna is favorable since no electronic elements or wiring (which may affect radiation characteristic) are disposed around the heat vent structure.

Although the invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. A handheld electronic device, comprising:

a main body;

a heat vent structure, disposed on the main body, wherein the main body and the heat vent structure are made of metal materials; and an antenna, disposed on the main body, configured for transmitting/receiving at least one of radio frequency signals, wherein the antenna is formed by using a fence structure of the heat vent structure and the fence structure is a part of the antenna, wherein the radio frequency signals comprise a first radio frequency signal and a second radio frequency signal, and wherein the fence structure further comprises a T-shaped radiating portion, comprising a connecting portion, a first radiating portion and a second radiating portion, the first radiating portion and the second radiating portion are vertical to the connecting portion, and the first radiating portion and the second radiating portion are extended away from each other, wherein a first mode is generated by the connecting portion and the first radiating portion for transmitting/receiving the first radio frequency signal, and a second mode is generated by the connecting portion and the second radiating portion for transmitting/receiving the second radio frequency signal;

at least one parasitic portion, adjacent to the T-shaped radiating portion, configured to adjust an impedance matching value for transmitting/receiving the first radio frequency signal and/or an impedance matching value for transmitting/receiving the second radio frequency signal;

an outer frame, connected to a system ground plane of the handheld electronic device; and a plurality of fences, acted as parasitic elements extended from the system ground plane through the outer frame.

2. The handheld electronic device of claim 1, wherein:

the main body comprises a first main body and a second main body, wherein the second main body is connected to the first main body through a pivotal shaft, and adapted for opening/closing relatively with the first main body.

3. The handheld electronic device of claim 1, wherein:

a center frequency of the first radio frequency signal is 5 G Hz; and a center frequency of the second radio frequency signal is 2.4 G Hz.

* * * * *